United States Patent [19]

Smith

[11] Patent Number: 4,618,175

[45] Date of Patent: Oct. 21, 1986

[54] FREEZE RESISTANT GATE LATCH

[75] Inventor: Robert W. Smith, Bloomington, Ill.

[73] Assignee: General Telephone of Illinois, Bloomington, Ill.

[21] Appl. No.: 751,639

[22] Filed: Jul. 3, 1985

[51] Int. Cl.[4] ..... E05C 3/04

[52] U.S. Cl. ..... 292/205; 292/238

[58] Field of Search ..... 292/230, 238, 205, 235, 292/104, 259, 130, 136

[56] References Cited

U.S. PATENT DOCUMENTS

| | | | |
|---|---|---|---|
| 168,754 | 10/1875 | Leach | 292/238 |
| 330,367 | 11/1885 | Atwood | 292/205 X |
| 482,246 | 9/1892 | Hagee | 292/136 |
| 557,578 | 4/1896 | Green | 292/136 |
| 1,145,788 | 7/1915 | Nelson | 292/104 X |
| 3,374,020 | 3/1968 | Berg | 292/148 |

FOREIGN PATENT DOCUMENTS

| | | | |
|---|---|---|---|
| 78498 | 4/1951 | Norway | 292/238 |

*Primary Examiner*—Richard E. Moore
*Attorney, Agent, or Firm*—J. Stephen Yeo

[57] ABSTRACT

A latch for securing two fence gates in a closed position includes a pivoted bar which is protected from freezing elements by channeled housings welded or otherwise attached to the gates. The latch can be made on site from readily available metal stock.

1 Claim, 4 Drawing Figures

FREEZE RESISTANT GATE LATCH

BACKGROUND OF THE INVENTION

This invention pertains to devices for securing fence gates in a closed position, and more particularly is concerned with latches for securing two fence gates together.

Previous devices for securing double fence gates have been prone to freezing under northern winter conditions. For example, a common arrangement involves the use of vertical sliding rods which are pushed into corresponding depressions in concrete pads. Snow or ice can fill the depressions or freeze the rods in position. It would be desirable to provide a fence latch substantially unaffected by freezing precipitation.

BRIEF DESCRIPTION OF THE INVENTION

DESCRIPTION OF THE INVENTION

Figure 1:
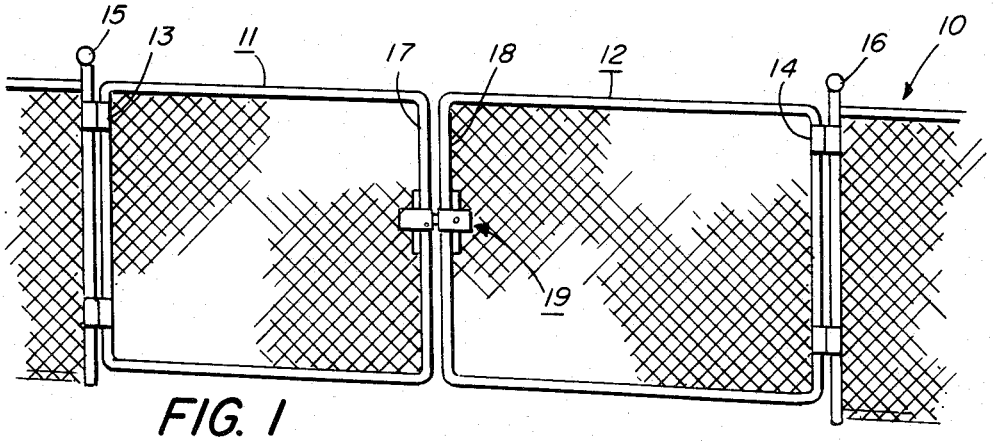
FIG. 1 is an overview of two fence gates carrying a latch embodying the invention.

Referring first to FIG. 1, there is seen a section of an outdoor security fence 10 with a first gate 11 and a second gate 12. Each gate 11,12 has a hinged end 13, 14 at which the gate is attached to fence posts 15, 16. Each gate 11,12 can be swung open with a free end 17, 18 moving in an arc. As a feature of the invention, a latch 19 is welded or otherwise securely attached to the free ends of the two gates.

Figure 2:
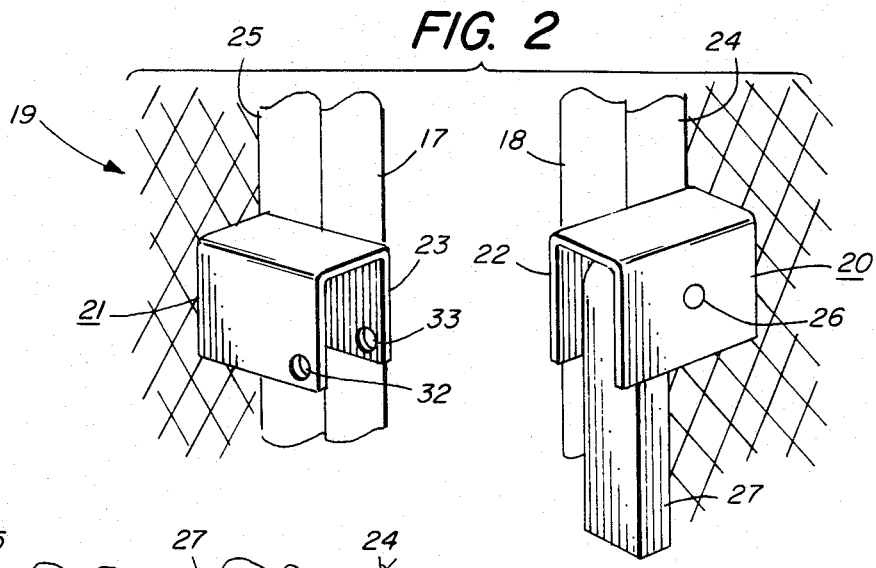
FIG. 2 is the latch in an open position.
Figure 3:
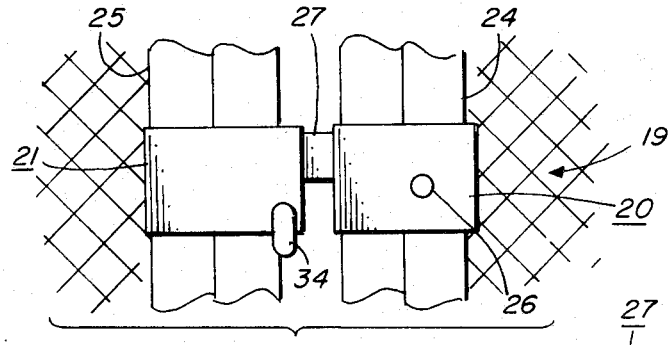
FIG. 3 is the latch in a closed position.

Details of the latch are best seen in FIGS. 2 and 3 which show the latch 19 in its open and closed positions respectively. The drawings are not to scale.

One of the two housings is called the pivot housing 20; the other housing is called the receiver housing 21. Each housing has a top and two sides defining a channel. The housings may be fabricated from lengths of 1.75 inch×1.75 inch steel channel stock. The pivot housing 20 and receiver housing 21 are arranged on the gates, so as to be aligned with their facing ends 22, 23 about one inch apart when both gates are in their closed position. If the gates are made with a tubular frame, a reinforcing member 24, 25 such as a piece of tubing or angle iron is welded to the frame at the free end of each gate. Each housing may be welded to its corresponding gate frame and reinforcing member.

The pivot housing 20 has a pivot hole 26 for pivotly mounting a bar 27. The pivot housing 20 may be 4 inches long.

Preferably, bar 27 is arranged so that it can be rotated about 90° from a vertical position when the gates are open to a horizontal position when the gates are secured together. The bar 27 may be fabricated from bar stock 1 inch wide, ½ inch thick and 10 inches long.

Figure 4:
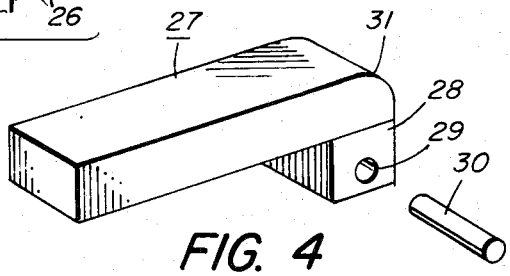
FIG. 4 shows a bar used in the latch.

As seen in FIG. 4, an offset piece 28 is welded to the pivoted end of the bar 27. The offset piece 28 is drilled to provide a pivot hole 29. A rod 30, such as a tempered steel rivet, extends between holes 26 in the pivot housing through pivot hole 29. A corner 31 of bar 27 may be beveled to provide clearance allowing the bar to hang vertically as seen in FIG. 2.

To secure the gates closed, the bar 27 is raised to its horizontal position as seen in FIG. 3. Further upward movement is prevented by the top of the housings 20, 21. Holes 32, 33 are located in the sides of the receiver housing, so that a padlock 34 or other type of locking mechanism may be used to hold bar 27 in a horizontal position. The receiver housing 21 may be about five inches long.

The only moving member of the latch 19 is the bar 27. The housings 20, 21 cover and protect the bar 27 when it is in the horizontal position from sleet and snow which would otherwise tend to accumulate on an unprotected bar.

The dimensions of the latch component are not critical and may be fabricated from standard commercial steel stock. Furthermore, a cable or other means than a padlock may hold the bar horizontal.

Therefore, the foregoing should be considered a description of the best embodiment while the scope of the invention is defined by the claims.

I claim:

1. A latch in combination with a first and a second gate, each of said gates having a pivot end and a free end, said latch comprised of:

(a) a pivot housing having a channel horizontally attached to the free end of said first gate, said channel having a top and two sides;

(b) a bar having a first end pivotally mounted in said pivot housing and arranged to hang vertically, and to rotate to a horizontal position; and (c) a receiver housing having a channel horizontally attached to the free side of said second gate, said channel having a top and two sides;

said receiving housing arranged to be aligned with said pivot housing when said gates are in a closed position, said receiving housing for receiving part of said bar when said bar is in a horizontal position, and including means for accepting a lock or other means for holding said bar in a horizontal position.

* * * * *